US009796951B2

(12) United States Patent
Detering et al.

(10) Patent No.: US 9,796,951 B2
(45) **Date of Patent: *Oct. 24, 2017**

(54) USE OF MODIFIED POLYASPARTIC ACIDS IN DISHWASHING DETERGENTS

(71) Applicant: BASF SE, Ludwigshafen (DE)

(72) Inventors: Jürgen Detering, Limburgerhof (DE); Gazi Türkoglu, Mannheim (DE); Dietrich Fehringer, Dielheim (DE); Heike Weber, Mannheim (DE)

(73) Assignee: BASF SE (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/022,017

(22) PCT Filed: Sep. 5, 2014

(86) PCT No.: PCT/EP2014/068924

§ 371 (c)(1),
(2) Date: Mar. 15, 2016

(87) PCT Pub. No.: WO2015/036325

PCT Pub. Date: Mar. 19, 2015

(65) Prior Publication Data

US 2016/0222322 A1 Aug. 4, 2016

(30) Foreign Application Priority Data

Sep. 16, 2013 (EP) ..... 13184570

(51) Int. Cl.
*C11D 1/66* (2006.01)
*C11D 3/33* (2006.01)
*C11D 3/37* (2006.01)

(52) U.S. Cl.
CPC ..... *C11D 3/3719* (2013.01); *C11D 1/66* (2013.01); *C11D 3/33* (2013.01)

(58) Field of Classification Search
CPC ..... C11D 1/66; C11D 3/33; C11D 3/3769
See application file for complete search history.

(56) References Cited

U.S. PATENT DOCUMENTS

| | | | | |
|---|---|---|---|---|
| 3,234,258 | A | 2/1966 | Morris | |
| 5,039,447 | A | 8/1991 | Reuben | |
| 5,075,041 | A | 12/1991 | Lutz | |
| 5,292,447 | A | 3/1994 | Venturello et al. | |
| 5,294,362 | A | 3/1994 | Venturello et al. | |
| 5,422,028 | A | 6/1995 | Oakes et al. | |
| 5,457,176 | A | 10/1995 | Adler et al. | |
| 5,710,327 | A | 1/1998 | Kroner et al. | |
| 5,747,635 | A * | 5/1998 | Kroner | C08F 283/04 426/51 |
| 6,001,798 | A | 12/1999 | Baur et al. | |
| 6,235,704 | B1 | 5/2001 | Detering et al. | |
| 6,271,901 | B1 | 8/2001 | Ide et al. | |
| 6,462,006 | B1 | 10/2002 | Sorg et al. | |
| 7,790,800 | B2 | 9/2010 | Suau et al. | |
| 8,524,649 | B2 | 9/2013 | Leyrer et al. | |

FOREIGN PATENT DOCUMENTS

| | | | |
|---|---|---|---|
| CA | 2053900 | A1 | 10/1990 |
| DE | 4221875 | A1 | 1/1994 |
| DE | 19532717 | A1 | 3/1997 |
| DE | 198 19 187 | A1 | 11/1999 |
| EP | 0013836 | A1 | 8/1980 |
| EP | 0747417 | A1 | 12/1996 |
| EP | 851 023 | A2 | 7/1998 |
| EP | 1083194 | A1 | 3/2001 |
| JP | 58-217598 | A | 12/1983 |
| WO | WO-90/13533 | A1 | 11/1990 |
| WO | WO-94/01486 | A1 | 1/1994 |
| WO | WO-95/07331 | A1 | 3/1995 |
| WO | WO-9521882 | A1 | 8/1995 |
| WO | WO-96/10025 | A1 | 4/1996 |
| WO | WO-96/25450 | A1 | 8/1996 |
| WO | WO-99/04313 | A1 | 1/1999 |
| WO | WO-99/06524 | A1 | 2/1999 |
| WO | WO-2006/016035 | A1 | 2/2006 |
| WO | WO-2009/019225 | A2 | 2/2009 |
| WO | WO-2009/095645 | A1 | 8/2009 |
| WO | WO-2011001170 | A1 | 1/2011 |

OTHER PUBLICATIONS

U.S. Appl. No. 15/022,037, filed Mar. 15, 2016, Detering et al.
U.S. Appl. No. 15/022,007, filed Mar. 15, 2016, Detering et al.
Fox, S., et al., "Thermal Polycondensation of Alpha-Amino Acids", A Laboratory Manual of Analytical Methods of Protein Chemistry vol. 4, Ed. P. Alexander & H. P. Ludgren, Oxford: Permagon Press, 1966, pp. 127-151.
International Search Report for PCT/EP2014/068924 mailed Nov. 28, 2014.

* cited by examiner

*Primary Examiner* — Brian P Mruk
(74) *Attorney, Agent, or Firm* — Drinker Biddle & Reath LLP

(57) ABSTRACT

The present invention relates to the use of modified polyaspartic acids in dishwashing detergents, in particular as dispersants, film inhibitors and spot inhibitors. The invention also relates to dishwashing detergent compositions comprising modified polyaspartic acids.

13 Claims, No Drawings

USE OF MODIFIED POLYASPARTIC ACIDS IN DISHWASHING DETERGENTS

CROSS-REFERENCE TO RELATED APPLICATIONS

This application is a national stage application (under 35 U.S.C. §371) of PCT/EP2014/068924, filed Sep. 5, 2014, which claims benefit of European Application No. 13184570.3, filed Sep. 16, 2013, both of which are incorporated herein by reference in their entirety.

The present invention relates to the use of modified polyaspartic acids in dishwashing detergents, in particular as dispersants, film inhibitors and spot inhibitors.

Polymers of carboxyl-group-containing monomers and obtainable by radical polymerization have been an important constituent of phosphate-containing and phosphate-free machine dishwashing detergents for many years. As a result of their soil-dispersing and film-inhibiting effect, they make a considerable contribution to the cleaning and clear rinse performance of the machine dishwashing detergents. For example, they ensure that no salt deposits of the hardness-forming calcium and magnesium ions are left behind on the ware. Homopolymers and copolymers of acrylic acid are often used for this purpose.

A disadvantage of these polymers of carboxyl-group-containing monomers obtainable by radical polymerization is that they are not biodegradable under aerobic conditions, as prevail e.g. in a communal sewage works.

On account of increasing environmental awareness, the demand for biodegradable polymeric alternatives to the polycarboxylates based on acrylic acid is therefore growing. However, commercially available biodegradable polymers such as, for example, polyaspartic acid or carboxymethylated inulin have only gained acceptance in commercial terms with difficulty. The reasons are manifold: inadequate effect in the specific application, excessively high costs on account of complex production processes and/or expensive feed materials, no or little flexibility of the polymer synthesis. For example, practiced processes for producing the polyaspartic acid do not allow for large variations with regard to structure, molecular weight and degree of neutralization, in contrast to the processes for producing polyacrylic acids. The polyaspartic acid is obtained in neutralized form as sodium salt. The molecular weights fluctuate between 2000-3000 g/mol or between 5000-6000 g/mol depending on the preparation process. Adaptation of the polymer structure or of the molecular weight to specific application requirements through targeted process changes is only possible to a very limited extent, if at all.

WO 2011/001170 describes cleaning compositions for machine dishwashing, comprising polyaspartic acid, a liquid nonionic surfactant and at least one solid nonionic surfactant, the preparation of polyaspartic acid not being described. WO 2009/095645 describes detergent and cleaner compositions which additionally comprise modified polyaspartic acids with polyaspartic acid as backbone as film preventers. The modified polyaspartic acids are obtained by reaction of the polyaspartic acid or of the polysuccinimide with PO/EO block copolymers, polyethyleneimine or adenosine triphosphate. Such a polyaspartic acid backbone can only be adjusted with difficulty, if at all, with regard to its molecular weight.

It was therefore the object of the invention to provide polymers as dishwashing detergent additives, in particular as additive to phosphate-free dishwashing detergent formulations for machine dishwashing, which can be used for film inhibition in water-conveying systems, can be variably adjusted in their polymer structure and their molecular weight and are biodegradable. The molecular weight of the polymers here can ideally be adjusted between 1000 and 10 000 g/mol.

This object was achieved by the present invention according to the claims and the following description and examples.

The present invention relates to the use of modified polyaspartic acids as additive in dishwashing detergents, and to dishwashing detergent composition comprising modified polyaspartic acids. The modified polyaspartic acids used in connection with the present invention are preparable by polycondensation of (i) 50 to 99 mol % of aspartic acid; and (ii) 1 to 50 mol % of at least one carboxyl-containing compound and subsequent hydrolysis of the cocondensates with the addition of a base, where (ii) is not aspartic acid. Besides the modified polyaspartic acids described here and to be used according to the invention, the dishwashing detergent composition according to the invention also comprises complexing agent, builders and/or cobuilders, nonionic surfactants, bleaches and/or bleach activators, enzymes and optionally further additives.

By virtue of the preparation process for polyaspartic acid described herein, following the step of the hydrolysis with the addition of a base, firstly the polyaspartic acid is obtained in salt form, as the person skilled in the art readily recognizes. The acid form of the polyaspartic acid can be obtained directly by a further step of acidification of the salt, which can be carried out in a manner known to the person skilled in the art. Suitable acids for this are, inter alia, mineral acids, for example sulfuric acid or hydrochloric acid. If only the salt of polyaspartic acid is desired, for example as intermediate, it is possible to dispense with the step of subsequent acidification. Wherever polyaspartic acid is discussed in connection with the present invention, its corresponding salts are accordingly also encompassed, as are obtainable or obtained by specified subsequent step of acidification and as recognized by the person skilled in the art. The optional acidification of the salt of modified polyaspartic acid can take place, for example, by adding a defined amount of a concentrated or dilute mineral acid such as, for example, sulfuric acid or hydrochloric acid to an aqueous sodium salt solution of the modified polyaspartic acid. The acidification can also take place by treatment with an acidic ion exchanger such as, for example, Amberlite IR 120 (hydrogen form), by allowing the aqueous Na salt solution of the modified polyaspartic acid to flow over a column packed with the ion exchanger.

The modified polyaspartic acids to be used according to the invention exhibit an extraordinarily good usability as additives in dishwashing detergents, in particular dishwashing detergents for machine dishwashing, and have very good dispersing, film inhibitor and spot inhibition properties. Furthermore, they are biodegradable and can be produced with variable molecular weights.

The present invention thus relates to the use of modified polyaspartic acid as additive—for example, but not limited to dispersant, film inhibitor or spot inhibitors—in dishwashing compositions, in particular dishwashing compositions for machine dishwashing, where the modified polyaspartic acid is preparable by polycondensation of (i) 50 to 99 mol %, preferably 60 to 95 mol %, particularly preferably 80 to 95 mol %, of aspartic acid; and (ii) 1 to 50 mol %, preferably 5 to 40 mol %, particularly preferably 5 to 20 mol %, of at least one carboxyl-containing compound, and subsequent hydrolysis of the cocondensates with the addition of a base, for example sodium hydroxide solution, where (ii) is not an aspartic acid.

The present invention also relates to dishwashing detergent compositions, in particular dishwashing detergent compositions for machine dishwashing, comprising modified polyaspartic acids preparable as illustrated and described herein. The description of the preparation of modified polyaspartic acids in connection with the present invention thus relates generally both to the use according to the invention of such modified polyaspartic acids as additive in dishwashing detergents, as well as their use as constituent of dishwashing detergent compositions according to the invention.

The aspartic acid (i) used in connection with the preparation of the polyaspartic acid to be used according to the invention can either be L- or D- and DL-aspartic acid. Preference is given to using L-aspartic acid.

The carboxyl-containing compound (ii) used in connection with the preparation of the polyaspartic acid to be used according to the invention can be, inter alia, a carboxylic acid (monocarboxylic acid or polycarboxylic acid), a hydroxycarboxylic acid and/or an amino acid (apart from aspartic acid). Such carboxylic acids or hydroxycarboxylic acids are preferably polybasic. In this connection, polybasic carboxylic acids can thus be used in the preparation of the polyaspartic acid to be used according to the invention, e.g. oxalic acid, adipic acid, fumaric acid, maleic acid, itaconic acid, aconitic acid, succinic acid, malonic acid, suberic acid, azelaic acid, diglycolic acid, glutaric acid. $C_1$-$C_{26}$ alkylsuccinic acids (e.g. octylsuccinic acid). $C_2$-$C_{26}$ alkenylsuccinic acids (e.g. octenylsuccinic acid), 1,2,3-propanetricarboxylic acid, 1,1,3,3-propanetetracarboxylic acid, 1,1,2,2-ethanetetracarboxylic acid, 1,2,3,4-butanetetracarboxylic acid, 1,2,2,3-propanetetracarboxylic acid, or 1,3,3,5-pentanetetracarboxylic acid. Furthermore, in this connection it is also possible to use polybasic hydroxycarboxylic acids, e.g. citric acid, isocitric acid, mucic acid, tartaric acid, tartronic acid, or malic acid. Amino acids that can be used in this connection are, inter alia, aminocarboxylic acids (e.g. glutamic acid, cysteine), basic diaminocarboxylic acids (e.g. lysine, arginine, histidine, aminocaprolactam), neutral amino acids (e.g. glycine, alanine, valine, leucine, isoleucine, methionine, cysteine, norleucine, caprolactam, asparagine, isoasparagine, glutamine, isoglutamine), aminosulfonic acids (e.g. taurine), hydroxylamino acids (e.g. hydroxyproline, serine, threonine), iminocarboxylic acids (e.g. proline, iminodiacetic acid), or aromatic and heterocyclic amino acids (e.g. anthranilic acid, tryptophan, tyrosine, histidine), but not aspartic acid. Preferred carboxyl-containing compounds (ii) in connection with the preparation of the modified polyaspartic acids to be used according to the invention are 1,2,3,4-butanetetracarboxylic acid, citric acid, glycine, glutamic acid, itaconic acid, succinic acid, taurine, maleic acid and glutaric acid, particularly preferably 1,2,3,4-butanetetracarboxylic acid, citric acid, glycine and glutamic acid.

Bases which can be used for the hydrolysis of the cocondensates in the preparation of the modified polyaspartic acids to be used according to the invention are: alkali metal and alkaline earth metal bases such as sodium hydroxide solution, potassium hydroxide solution, calcium hydroxide or barium hydroxide; carbonates such as sodium carbonate and potassium carbonate; ammonia and primary, secondary or tertiary amines; other bases with primary, secondary or tertiary amino groups. In connection with the present invention, preference is given to sodium hydroxide solution or ammonium hydroxide.

The preparation of the modified polyaspartic acids to be used according to the invention takes place generally via a polycondensation of aspartic acid with at least one carboxyl-containing compounds (not aspartic acid) and subsequent hydrolysis of the cocondensates with the addition of a base as illustrated and described above and below. The preparation of such modified polyaspartic acids is also described, by way of example in DE 4221875.6. The preparation of the modified polyaspartic acids to be used according to the invention is described by way of example hereinbelow. This preparation description must not be understood as being limiting with regard to the modified polyaspartic acids to be used according to the invention. The polyaspartic acids to be used according to the invention comprise not only those which are prepared by the following preparation description, but also those which are preparable by the subsequent process. The modified polyaspartic acids to be used according to the invention can be prepared e.g. by polycondensation of components (i) and (ii), i.e. aspartic acid and at least one carboxyl-containing compound in the molar ratios as described herein. The polycondensation can take place at temperatures from 100 to 270° C., preferably at 120 to 250° C., particularly preferably at 180 to 220° C. The condensation (the heating) is preferably carried out in vacuo or under an inert gas atmosphere (e.g. $N_2$ or argon). However, the condensation can also take place under increased pressure or in a gas stream, e.g. carbon dioxide, air, oxygen or water vapor. The reaction times for the condensation are generally between 1 minute and 50 hours, preferably between 5 and 8 hours, depending on the chosen reaction conditions. The polycondensation can be carried out, for example, in solid phase, by firstly preparing an aqueous solution or suspension of aspartic acid and at least one carboxyl-containing compound (ii) and evaporating the solution to dryness. During this, a condensation may already start. Examples of suitable reaction apparatuses for the condensation are heating belts, kneaders, mixers, paddle dryers, extruders, rotary kilns and other heatable devices in which the condensation of solids can be carried out with the removal of water of reaction. Polycondensates with a low molecular weight can be prepared in also pressure-tight sealed vessels by not removing, or only partially removing, the water of reaction which is formed. The polycondensation can also be carried out by infrared radiation or microwave radiation. An acid-catalyzed polycondensation is also possible, for example with inorganic acids of phosphorus or sulfur or with hydrogen halides. Acid-catalyzed polycondensations of this type are also described in DE 4221875.6.

By adding small amounts of methanesulfonic acid during the polycondensation of aspartic acid, it is possible to control the molecular weight of the polyaspartic acid, obtained following hydrolysis of the polysuccinimide intermediate. In the context of the present invention, it is thus possible to prepare modified polyaspartic acid to be used according to the invention by also using methanesulfonic acid as additive in the polycondensation besides aspartic acid (i) and a carboxyl-containing compound (ii), and then hydrolyzing the resulting cocondensate with a base as described here. The molar ratio of aspartic acid (i) and of a carboxyl-containing compound (ii) on the one side to methanesulfonic acid on the other side in the condensation step should here be ideally 200:1 to 5:1, preferably 100:1 to 10:1, particularly preferably 50:1 to 12:1. In this embodiment of the present invention, for the preparation of the modified polyaspartic acid to be used according to the invention, 50 to 99 mol %, preferably 60 to 95 mol %, particularly preferably 80 to 95 mol %, of aspartic acid and 1 to 50 mol %, preferably 5 to 40 mol %, particularly preferably 5 to 20 mol %, of a carboxyl-containing compound are thus polycondensed with methanesulfonic acid in a ratio of 200:1 to 5:1, preferably 100:1 to 10:1, particularly preferably 50:1 to 12:1, as described herein. Methanesulfonic acid is biodegradable like polyaspartic acid. Small amounts of methanesulfonic acid can remain in the polymer product without ecological disadvantages arising and without the performance in numerous applications being influenced. Complex work-up or purification is unnecessary. Yield losses as a result of work-up are avoided.

During the thermal polycondensation of aspartic acid with a comtemplated carboxyl-containing compounds (ii) (with or without methanesulfonic acid), the polycondensate is generally produced in the form of the water-insoluble modified polyaspartimides, in a few cases in water-soluble form (e.g. in the case of the polycondensation of L-aspartic acid with citric acid). The cocondensates of aspartic acid can be purified from the unreacted starting materials, for example, by comminuting the condensation product and extracting it with water at temperatures from 10 to 100° C. During this, the unreacted feed materials are dissolved out and optionally used methanesulfonic acid is washed out. Unreacted aspartic acid can be easily dissolved out by extraction with 1 N hydrochloric acid.

The modified polyaspartic acids are preferably obtained from the polycondensates by slurrying the polycocondensates in water, or dissolving them (if the polycocondensate is already water-soluble, e.g. polycocondensate from L-aspartic acid and citric acid), and hydrolyzing and neutralizing them at temperatures preferably in the range from 0 to 90° C. with the addition of a base. The hydrolysis and neutralization preferably takes place at pHs of 8 to 10. Suitable bases are, for example, alkali metal and alkaline earth metal bases such as sodium hydroxide solution, potassium hydroxide solution, calcium hydroxide or barium hydroxide. Suitable bases are also, for example, carbonates such as sodium carbonate and potassium carbonate. Suitable bases are also ammonia and primary, secondary or tertiary amines and other bases with primary, secondary or tertiary amino groups. If using amines for the reaction of polyaspartamide, the amines can be bonded to the polyaspartic acid either like a salt or like an amide on account of their high reactivity. In the case of the treatment with bases, partially or completely neutralized polycocondensates are obtained which comprise, according to the feed in the preceding polycondensation, 50 to 99 mol % of aspartic acid according to (i), and 1 to 50 mol % of at least one carboxyl-group-containing compound (ii) (with or without methanesulfonic acid in ratios as described herein), in the form of the salts corresponding to the bases.

The modified polyaspartic acids to be used according to the invention and/or their salts can be used as aqueous solution or in solid form, e.g. in powder or granule form. As is known to the person skilled in the art, the powder or granule form can be obtained for example by spray drying, spray granulation, fluidized-bed spray granulation, roller drying or freeze drying of the aqueous solution of the polyaspartic acids or their salts.

The present invention also relates to dishwashing detergent compositions, in particular dishwashing detergent compositions suitable for machine dishwashing which, besides the modified polyaspartic acids described here and to be used according to the invention, also comprise complexing agents, builders and/or cobuilders, nonionic surfactants, bleaches and/or bleach activators, enzymes and optionally further additives such as solvents. The modified polyaspartic acids described here and to be used according to the invention can be incorporated directly into the formulations (mixtures) in their various presentation forms by processes known to the person skilled in the art. In this connection, solid formulations such as powders, tablets, gel-like formulations and liquid formulations, inter alia, are to be mentioned.

The modified polyaspartic acids described here and to be used according to the invention can be used particularly advantageously in machine dishwashing detergents. They are characterized here in particular by their film-inhibiting effect both towards inorganic and organic films. In particular, they inhibit films made of calcium and magnesium carbonate and calcium and magnesium phosphates and phosphonates. Additionally, they prevent deposits which originate from the soil constituents of the wash liquor, such as grease, protein and starch films.

The dishwashing detergent compositions according to the invention can be provided in liquid, gel-like or solid form, as one or more phases, as tablets or in the form of other dosing units, packaged or unpackaged.

The modified polyaspartic acids described here and to be used according to the invention can be used either in multicomponent product systems (separate use of detergent, rinse aid and regenerating salt), or else in those dishwashing detergents in which the functions of detergent, rinse aid and regenerating salt are combined in one product (e.g. 3-in-1 products, 6-in-1 products, 9-in-1 products, all-in-one products).

The dishwashing detergent compositions according to the invention comprise (a) 1-20% by weight, preferably 1-15% by weight, particularly preferably 2-12% by weight, of at least one modified polyaspartic acid described here and to be used according to the invention;
(b) 0-50% by weight of complexing agents;
(c) 0.1-80% by weight of builders and/or cobuilders;
(d) 0.1-20% by weight of nonionic surfactants;
(e) 0-30% by weight of bleaches, bleach activators and bleach catalysts;
(f) 0-8% by weight of enzyme; and
(g) 0-50% by weight of additives.

The dishwashing detergent composition according to the invention is suitable in particular as dishwashing detergent composition for machine dishwashing. In one embodiment, the dishwashing detergent composition according to the invention is therefore a machine dishwashing detergent composition.

Examples of complexing agents (b) which can be used are: nitrilotriacetic acid, ethylenediaminetetraacetic acid, diethylenetriaminepentaacetic acid, hydroxyethyl-ethylenediaminetriacetic acid, methylglycinediacetic acid, glutamic acid dieacetic acid, iminodisuccinic acid, hydroxyiminodisuccinic acid, ethylenediaminedisuccinic acid, aspartic acid diacetic acid, and in each case salts thereof. Preferred complexing agents (b) are methylglycinediacetic acid and glutamic acid diacetic acid and salts thereof. Particularly preferred complexing agents (b) are methylglycinediacetic acid and salts thereof. According to the invention, preference is given to 3 to 50% by weight of complexing agents (b).

Builders and/or cobuilders (c) that can be used are, in particular, water-soluble or water-insoluble substances, the main task of which consists in the binding of calcium and magnesium ions. These may be low molecular weight carboxylic acids, and salts thereof such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate and α-hydroxypropionoic acid.

A further substance class with cobuilder properties which can be present in the cleaners according to the invention is the phosphonates. These are in particular hydroxylalkane- and aminoalkanephosphonates. Among the hydroxyalkanephosphonates, 1-hydroxyethane-1,1-diphosphonate (HEDP) is of particular importance as cobuilder. It is preferably used as sodium salt, with the disodium salt giving a neutral reaction and the tetrasodium salt an alkaline reaction (pH 9). Suitable aminoalkanephosphonates are preferably ethylenediaminetetra-methylenephosphonate (EDTMP), diethylenetriaminepentamethylenephosphonate (DTPMP), and higher homologs thereof. They are preferably used in the form of the neutrally reacting sodium salts, e.g. as hexasodium salt of EDTMP or as hepta- and octasodium salt of DTPMP. The builder used here from the class of phosphonates is preferably HEDP. Moreover, the aminoalkanephosphonates have a marked heavy metal binding capacity. Accordingly, particularly if the compositions also comprise bleaches, it may be preferred to use aminoalkanephosphonates, in particular DTPMP, or to use mixtures of the specified phosphonates.

Inter alia, silicates can be used as builders. Crystalline layered silicates with the general formula $NaMSi_xO_{2x+1}$ $yH_2O$, may be present, where M is sodium or hydrogen, x is a number from 1.9 to 22, preferably from 1.9 to 4, where particularly preferred values of x are 2, 3 or 4 and y is a number from 0 to 33, preferably 0 to 20. In addition, amorphous sodium silicates with an $SiO_2$: $Na_2O$ ratio of 1 to 3.5, preferably from 1.6 to 3 and in particular from 2 to 2.8, can be used. Furthermore, builders and/or cobuilders (c) which can be used in connection with the dishwashing detergent composition according to the invention are carbonates and hydrocarbonates, among which the alkali metal salts, in particular sodium salts, are preferred. As cobuilders, it is also possible to use homopolymers and copolymers of acrylic acid or of methacrylic acid which preferably have a weight-average molar mass of 2000 to 50 000 g/mol. Suitable comonomers are in particular monoethylenically unsaturated dicarboxylic acids such as maleic acid, fumaric acid and itaconic acid, and anhydrides thereof such as maleic anhydride. Comonomers containing sulfonic acid groups, such as 2-acrylamido-2-methylpropanesulfonic acid, allylsulfonic acid and vinylsulfonic acid, are also suitable. Hydrophobic comonomers are also suitable, such as, for example, isobutene, diisobutene, styrene, alpha-olefins with 10 or more carbon atoms. Hydrophilic monomers with hydroxy function or alkylene oxide groups can likewise be used as comonomers. For example, mention may be made of: allyl alcohol and isoprenol, and alkoxylates thereof and methoxypolyethylene glycol (meth)acrylate.

Preferred amounts of builders and/or cobuilders in connection with the dishwashing detergent composition according to the invention are 5 to 80% by weight, particularly preferably 10 to 75% by weight, 15 to 70% by weight or 15 to 65% by weight.

Nonionic surfactants (d) which can be used in connection with the dishwashing detergent composition according to the invention are, for example, weakly foaming or low-foam nonionic surfactants. These can be present in fractions from 0.1 to 20% by weight, preferably from 0.1 to 15% by weight, particularly preferably from 0.25 to 10% by weight or 0.5 to 10% by weight. Suitable nonionic surfactants comprise, inter alia, surfactants of the general formula (I)

$$R^1—O—(CH_2CH_2O)_a—(CHR^2CH_2O)_b—R^3 \quad (I),$$

in which $R^1$ is a linear or branched alkyl radical having 8 to 22 carbon atoms, $R^2$ and $R^3$, independently of one another, are hydrogen or a linear or branched alkyl radical having 1 to 10 carbon atoms or H, where $R^2$ is preferably methyl, and a and b, independently of one another, are 0 to 300. Preferably, a=1-100 and b=0-30.

Also of suitability in the context of the present invention are surfactants of the formula (II)

$$R^4—O—[CH_2CH(CH_3)O]_c[CH_2CH_2O]_d[CH_2CH(CH_3)O]_eCH_2CH(OH)R^5 \quad (II),$$

in which $R^4$ is a linear or branched aliphatic hydrocarbon radical having 4 to 22 carbon atoms or mixtures thereof, $R^5$ is a linear or branched hydrocarbon radical having 2 to 26 carbon atoms or mixtures thereof, c and e are values between 0 and 40, and d is a value of at least 15.

Also suitable in the context of the present invention are surfactants of the formula (III)

$$R^6O—(CH_2CHR^7O)_f(CH_2CH_2O)_g(CH_2CHR^8O)_h—CO—R^9 \quad (III),$$

in which $R^6$ is a branched or unbranched alkyl radical having 8 to 16 carbon atoms, $R^7$, $R^8$, independently of one another, are H or a branched or unbranched alkyl radical having 1 to 5 carbon atoms, $R^9$ is an unbranched alkyl radical having 5 to 17 carbon atoms, f, h, independently of one another, are a number from 1 to 5, and g is a number from 13 to 35.

The surfactants of the formulae (I), (II) and (III) can either be random copolymers or block copolymers, they are preferably in the form of block copolymers.

Furthermore, in connection with the present invention, it is possible to use di- and multiblock copolymers composed of ethylene oxide and propylene oxide, which are commercially available, for example, under the name Pluronic® (BASF SE) or Tetronic® (BASF Corporation). Furthermore, reaction products of sorbitan esters with ethylene oxide and/or propylene oxide can be used. Likewise of suitability are amine oxides or alkyl glycosides. An overview of suitable nonionic surfactants is disclosed in EP-A 851 023 and in DE-A 198 19 187.

Mixtures of two or more different nonionic surfactants can also be present. The dishwashing detergent compositions according to the invention can furthermore comprise anionic or zwitterionic surfactants, preferably in a mixture with nonionic surfactants. Suitable anionic and zwitterionic surfactants are likewise mentioned in EP-A851 023 and DE-A 198 19 187.

Bleaches and bleach activators (e) that can be used in connection with the dishwashing detergent compositions according to the invention are representatives known to the person skilled in the art. Bleaches are divided into oxygen bleaches and chlorine-containing bleaches. Oxygen bleaches used are alkali metal perborates and hydrates thereof, as well as alkali metal percarbonates. Preferred bleaches here are sodium perborate in the form of the mono- or tetrahydrate, sodium percarbonate or the hydrates of sodium percarbonate. As oxygen bleaches it is likewise possible to use persulfates and hydrogen peroxide. Typical oxygen bleaches are also organic peracids such as, for example, perbenzoic acid, peroxy-alpha-naphthoic acid, peroxylauric acid, peroxystearic acid, phthalimidoperoxycaproic acid, 1,12-diperoxydodecanedioic acid, 1,9-diperoxyazelaic acid, diperoxoisophthalic acid or 2-decyldiperoxybutane-1,4-dioic acid. Moreover, the following oxygen bleaches can also be used in the dishwashing detergent composition: cationic peroxy acids, which are described in the patent applications U.S. Pat. No. 5,422,028, U.S. Pat. No. 5,294,362, and U.S. Pat. No. 5,292,447, and sulfonylperoxy acids, which are described in the patent application U.S. Pat. No. 5,039,447. Oxygen bleaches can be used in amounts of in general 0.1 to 30% by weight, preferably from 1 to 20% by weight, particularly preferably from 3 to 15% by weight, based on the total dishwashing detergent composition.

Chlorine-containing bleaches as well as the combination of chlorine-containing bleaches with peroxide-containing bleaches can likewise be used in connection with the dishwashing detergent compositions according to the invention. Known chlorine-containing bleaches are, for example, 1,3-dichloro-5,5-dimethylhydantoin, N-chlorosulfamide, chloramine T, dichloramine T, chloramine B, N,N'-dichlorobenzoylurea, p-toluenesulfonedichloroamide or trichloroethylamine. Preferred chlorine-containing bleaches here are sodium hypochlorite, calcium hypochlorite, potassium hypochlorite, magnesium hypochlorite, potassium dichloroisocyanurate or sodium dichloroisocyanurate. Chlorine-containing bleaches can be used in this connection in amounts of from 0.1 to 30% by weight, preferably from 0.1 to 20% by weight, preferably from 0.2 to 10% by weight, particularly preferably from 0.3 to 8% by weight, based on the total dishwashing detergent composition.

Furthermore, bleach stabilizers such as, for example, phosphonates, borates, metaborates, metasilicates or magnesium salts, can be added in small amounts.

Bleach activators in the context of the present invention can be compounds which, under perhydrolysis conditions, produce aliphatic peroxocarboxylic acids having preferably 1 to 10 carbon atoms, in particular 2 to 4 carbon atoms, and/or substituted perbenzoic acid. Of suitability in this connection are, inter alia, compounds which comprise one or more N- or O-acyl groups and/or optionally substituted benzoyl groups, for example substances from the class of anhydrides, esters, imides, acylated imidazoles or oximes. Examples are tetraacetyl-ethylenediamine (TAED), tetraacetylmethylenediamine (TAMD), tetraacetyl glycol uril (TAGU), tetraacetylhexylenediamine (TAHD), N-acylimides, such as, for example, N-nona-noylsuccinimide (NOSI), acylated phenolsulfonates, such as, for example, n-nonanoyl- or isononanoyloxybenzenesulfonates (n- or iso-NOBS), pentaacetyl glucose (PAG), 1,5-diacetyl-2,2-dioxohexahydro-1,3,5-triazine (DADHT) or isatoic anhydride (ISA). Likewise suitable as bleach activators are nitrile quats such as, for example, N-methylmorpholinium acetonitrile salts (MMA salts) or trimethylammonium acetonitrile salts (TMAQ salts). Preferably of suitability are bleach activators from the group consisting of polyacylated alkylenediamines, particularly preferably TAED, N-acylimides, particularly preferably NOSI, acylated phenolsulfonates, particularly preferably n- or iso-NOBS, MMA, and TMAQ. Bleach activators can be used in connection with the present invention in amounts of from 0.1 to 30% by weight, preferably from 0.1 to 10% by weight, preferably from 1 to 9% by weight, particularly preferably from 1.5 to 8% by weight, based on the total dishwashing detergent composition.

In addition to the conventional bleach activators, or instead of them, it is also possible to incorporate so-called bleach catalysts into rinse aid particles. These substances are bleach-boosting transition metal salts or transition metal complexes such as, for example, manganese-, iron-, cobalt-, ruthenium- or molybdenum-salene complexes or carbonyl complexes. Manganese, iron, cobalt, ruthenium, molybdenum, titanium, vanadium and copper complexes with nitrogen-containing tripod ligands, and also cobalt-, iron-, copper- and ruthenium-amine complexes can also be used as bleach catalysts.

As component (f), the dishwashing detergent compositions according to the invention can comprise 0 to 8% by weight of enzymes. If the dishwashing detergent compositions comprise enzymes, they preferably comprise these in amounts of from 0.1 to 8% by weight. Enzymes can be added to the dishwashing detergent in order to increase the cleaning performance or, under more mild conditions (e.g. at lower temperatures), to ensure the cleaning performance in identical quality. The enzymes can be used in free form or chemically or physically immobilized form on a support, or in encapsulated form. The most often used enzymes include in this connection lipases, amylases, cellulases and proteases. Furthermore, esterases, pectinases, lactases and peroxidases can also be used. According to the invention, preference is given to using amylases and proteases.

As additives (g), in connection with the dishwashing detergent compositions according to the invention, for example anionic or zwitterionic surfactants, alkali carriers, polymeric dispersants, corrosion inhibitors, antifoams, dyes, fragrances, fillers, tablet disintegrants, organic solvents, tableting auxiliaries, disintegrants, thickeners, solubility promoters, or water can be used. Alkali carriers that can be used are, for example, besides the ammonium or alkali metal carbonates, ammonium or alkali metal hydrogencarbonates and ammonium or alkali metal sesquicarbonates already specified for the builder substances, also ammonium or alkali metal hydroxides, ammonium or alkali metal silicates and ammonium or alkali metasilicates, and mixtures of the aforementioned substances.

As corrosion inhibitors, it is possible to use, inter alia, silver protectors from the group of triazoles, benzotriazoles, bisbenzotriazoles, aminotriazoles, alkylaminotriazoles and the transition metal salts or complexes.

To prevent glass corrosion, which is evident from clouding, iridescence, streaking and lines on the glassware, preference is given to using glass corrosion inhibitors. Preferred glass corrosion inhibitors are for example, magnesium, zinc and bismuth salts and complexes.

Paraffin oils and silicon oils can optionally be used according to the invention as antifoams and for protecting plastic and metal surfaces. Antifoams are preferably used in fractions of from 0.001% by weight to 5% by weight. Moreover, dyes such as, for example, patent blue, preservatives such as, for example, Kathon CG, perfumes and other fragrances can be added to the cleaning formulation according to the invention.

A suitable filler in connection with the dishwashing detergent compositions according to the invention is, for example, sodium sulfate.

Further possible additives in connection with the present invention are amphoteric and cationic polymers.

In one embodiment, the dishwashing detergent composition according to the invention is phosphate-free. In this connection, the term "phosphate-free" also comprises those dishwashing detergent compositions which comprise essentially no phosphate, i.e., phosphate in technically ineffective amounts. This comprises in particular compositions with less than 1.0% by weight, preferably less than 0.5% by weight, phosphate, based on the total composition.

The examples below serve to illustrate the present invention and must not be understood as being a limitation thereof.

EXAMPLE 1

Preparation of the Modified Polyaspartic Acids

Molar ratios are given in each case.

Polymers According to the Invention

Polymer 1: polycondensate of L-aspartic acid/BTC 1.0:0.1

Polymer 1b: polycondensate of L-aspartic acid/BTC 1.0:0.1 in the presence of 5 mol % (based on L-Asp) of methanesulfonic acid Polymer 2: polycondensate of L-aspartic acid/BTC 1.0:0.2

Polymer 3: polycondensate of L-aspartic acid/citric acid 1.0:0.5

Polymer 4: polycondensate of L-aspartic acid/glycine 1.0:0.1

Polymer 5: polycondensate of L-aspartic acid/glutaminic acid 1.0:0.1

Polymer 5b: polycondensate of L-aspartic acid/glutaminic acid 1.0:0.1 in the presence of 5 mol % (based on L-Asp) of methanesulfonic acid BTC=1,2,3,4 butanetetracarboxylic acid Comparison Polymers Polymer C1: polyaspartic acid Na salt, Mw 3000 g/mol Polymer C2: polyaspartic acid, Na salt, Mw 5400 g/mol Polymers According to the Invention Polymer 1:

A 2 l capacity reactor with stirrer was charged with 133.10 g of L-aspartic acid, 70 g of water and 23.42 g of 1,2,3,4-butanetetracarboxylic acid. The reaction mixture was heated with stirring for 4 h at a temperature of 210° C. while simultaneously distilling off water. The resulting melt of the modified polyaspartamide was cooled and then comminuted. In order to prepare the aqueous sodium salt solution of the modified polyaspartic acid, 100 g of the comminuted reaction mass was dispersed into 100 g of water, the mixture was heated to 70° C. and, at this temperature, enough of a 50% strength aqueous sodium hydroxide solution was added for the pH to be in the range of 7-8. During this, the powder dispersed in water gradually dissolved, giving a clear aqueous sodium salt solution of the modified polyaspartic acid. The weight-average molecular weight (Mw) of the modified polyaspartic acid was 2600 g/mol.

Polymer 1b:

The synthesis and work-up of this polymer took place precisely as described in polymer 1, but additionally charging 4.81 g of methanesulfonic acid to the reactor. The weight-average molecular weight (Mw) of the modified polyaspartic acid was 3300 g/mol.

Polymer 2:

Analogously to the preparation of polymer 1, 133.10 g of L-aspartic acid and 46.83 g of 1,2,3,4-butanetetracarboxylic acid were charged to the reactor and polycondensed for 2.5 h at 240° C. The resulting melt of the modified polyaspartamide was cooled, comminuted and hydrolyzed as described in example 1 to give an aqueous sodium salt solution of the modified polyaspartic acid. The weight-average molecular weight (Mw) of the modified polyaspartic acid was 1870 g/mol.

Polymer 3:

Analogously to the preparation of polymer 1, 133.10 g of L-aspartic acid and 96.07 g of citric acid were charged to the reactor and polycondensed for 5 h at 180° C. The resulting melt of the modified polyaspartamide was cooled and then comminuted. In order to prepare the aqueous sodium salt solution of the modified polyaspartic acid, 100 g of the cooled and comminuted reaction mass were dissolved in 100 g of water and, with ice cooling, enough of a 50% strength aqueous sodium hydroxide solution was added for the pH to be in the range 7-8. The weight-average molecular weight (Mw) of the modified polyaspartic acid was 1320 g/mol.

Polymer 4:

Analogously to the preparation of polymer 1, 133.10 g of L-aspartic acid, 30.00 g of water and 7.51 g of glycine were charged to the reactor and polycondensed for 7 h at 220° C. The resulting melt of the modified polyaspartamide was cooled, comminuted and hydrolyzed as described in example 1 to give an aqueous sodium salt solution of the modified polyaspartic acid. The weight-average molecular weight (Mw) of the modified polyaspartic acid was 6060 g/mol.

Polymer 5:

Analogously to example 1, 133.10 g of L-aspartic acid, 30.00 g of water and 14.71 g of L-glutaminic acid were charged to the reactor and polycondensed for 7.5 h at 220° C. The resulting melt of the modified polyaspartamide was cooled, comminuted and hydrolyzed as described in example 1 to give an aqueous sodium salt solution of the modified polyaspartic acid. The weight-average molecular weight (Mw) of the modified polyaspartic acid was 3810 g/mol.

Polymer 5b:

The synthesis and work-up of this polymer took place precisely as described in polymer 5, but additionally charging 4.81 g of methanesulfonic acid to the reactor. The weight-average molecular weight (Mw) of the modified polyaspartic acid was 6100 g/mol.

Comparison Polymers

Polymer C1 (Polyaspartic Acid M):

In a round-bottomed flask, 10 g of maleamide (prepared by the reaction of maleic anhydride with ammonia) were polycondensed for 2 h at 240° C. The reaction mass swelled up like a foam during this and could be readily comminuted after cooling. The comminuted polyaspartamide was hydrolyzed as described in example 1 to give an aqueous polyaspartic acid sodium salt solution. The weight-average molecular weight (Mw) was 3000 g/mol.

Polymer C2 (Polyaspartic Acid T):

In a rotary evaporator, 133.10 g of L-aspartic acid were polycondensed for 2 h at a temperature of 220-240° C. The resulting polyaspartamide was hydrolyzed as described in example 1 to give an aqueous polyaspartic acid sodium salt solution. The weight-average molecular weight (Mw) was 5400 g/mol.

EXAMPLE 2

Determination of the Molecular Weight (Mw)

The weight-average molecular weight (Mw) of the examples was determined with the help of GPC (gel permeation chromatography) under the following conditions:

| | |
|---|---|
| Column | Suprema 100 10μ (Polymer Standard Service) |
| Eluent | 0.08 mol/l TRIS buffer pH = 7.0 in dest. water + 0.15 mol/l NaCl + 0.01 mol/l $NaN_3$ |
| Column temperature | 35° C. |
| Flow rate | 0.8 mL/min |
| Injection | 100 μL |

-continued

| | |
|---|---|
| Concentration | 1.5 mg/mL |
| Detector | DR1 Agilent 1100UV GAT-LCD 503 (260 nm) |

Sample solutions were filtered over Sartorius Minisart RC 25 (0.2 μm). Calibration was carried out with narrowly distributed Na-PAA standards from Polymer Standard Service with molecular weights of M=1250 to M=193 800. Additionally, Na acrylate with a molecular weight of M=96 and a PEG standard with M=620, which equates with Na-PAA M=150 was. The values outside of this elution range were extrapolated. The evaluation limit was approx. M=298 g/mol.

EXAMPLE 3

Dishwasher Tests

The polymers were tested in the following phosphate-free test formulation PF1. The composition of the test formulation PF1 is given in table 1 (data in % by weight).

TABLE 1 test formulation PF1

| Constituent | PF 1 |
|---|---|
| Protease | 2.5 |
| Amylase | 1.0 |
| Nonionic surfactant | 5 |
| Polymer | 10 |
| Sodium percarbonate | 10.2 |
| Tetraacetylethylenediamine | 4 |
| Sodium disilicate | 2 |
| Sodium carbonate | 19.5 |
| Sodium citrate dihydrate | 35 |
| Methylglycinediacetic acid, Na salt | 10 |
| Hydroxyethane-(1,1-diphosphonic acid) | 0.8 |

Data in % by weight, based on the total amount of all components

Here, the following experimental conditions were observed:

Dishwasher: Miele G 1222 SCL

Program: 65° C. (with prerinse)

Wear: 3 knives (Karina nickel chrome knives, Solex Germany GmbH, Eisingen/Germany)

3 Amsterdam 0.2 L drinking glasses

3 "OCEAN BLUE" BREAKFAST PLATES (MELAMINE)

3 porcelain plates: RIMMED PLATE FLAT 19 CM

Arrangement: Knives in the cutlery tray, glasses in the upper basket, plates arranged in the lower basket Dishwashing detergent: 18 g Addition of soiling: 50 g of ballast soiling is dosed, in thawed form, with the formulation after the prerinse; see below for composition Clear rinse temperature: 65° C.

Water hardness: 21° German hardness (Ca/Mg): HCO3 (3:1): 1.35

Rinse cycles:—15; in each case 1 h break in between (10 min closed door, 50 min opened door)

Evaluation: Visually after 15 wash cycles

The evaluation of the wear was carried out after 15 cycles in a darkened chamber under light behind an aperture plate using a grading scale from 10 (very good) to 1 (very poor). Grades from 1 to 10 were awarded both for spotting (very many, intensive spots=1, no spots=10), as well as for the film (1=very considerable film, 10=no film)

Composition of the Ballast Soiling:

Starch: 0.5% potato starch, 2.5% gravy

Grease: 10.2% margarine

Protein: 5.1% egg yolk, 5.1% milk

Others: 2.5% tomato ketchup, 2.5% mustard, 0.1% benzoic acid, 71.5% water

Result:

The formulations with modified polyaspartic acid according to the invention are characterized in particular by their very high film-inhibiting effect towards inorganic and organic deposits on glass and knives. Furthermore, they increased the cleaning power of the dishwashing detergent and favored the run-off of the water from the wear, meaning that particularly clear glasses and shining metal cutlery items were obtained.

Table 2 below lists the grades for filming (F) and spotting (S) on knives and drinking glasses.

TABLE 2 test results test formulation 1 (PF 1)

| Polymer | Knives (F + S) | Glasses (F + S) |
|---|---|---|
| Without polymer | 7.0 | 7.0 |
| Polymer 1 | 15.3 | 11.7 |
| Polymer 1b | 15.7 | 12.0 |
| Polymer 2 | 14.6 | 11.7 |
| Polymer 3 | 12.7 | 10.0 |
| Polymer 4 | 14.0 | 10.3 |
| Polymer 5 | 13.7 | 10.3 |
| Polymer 5b | 114.3 | 11.1 |
| Polymer C1 | 8.3 | 7.7 |
| Polymer C2 | 11.4 | 9.0 |

The invention claimed is:

1. An additive in dishwashing detergents which comprises a modified polyaspartic acid is preparable by polycondensation of (i) 50 to 99 mol % of aspartic acid and methanesulfonic acid in a ratio of 200:1 to 5:1; and (ii) 1 to 50 mol % of at least one carboxyl-containing compound, and subsequent hydrolysis of the cocondensates with the addition of a base, where (ii) is not aspartic acid.

2. The additive according to claim 1, where (i) is 50 to 95 mol % of aspartic acid and (ii) is 5 to 50 mol % of at least one carboxyl-containing compound.

3. The additive according to claim 1, where (i) is 80 to 95 mol % of aspartic acid and (ii) is 5 to 20 mol % of at least one carboxyl-containing compound.

4. The additive according to claim 1, where (ii) is a monocarboxylic acid, a polycarboxylic acid, a hydroxycarboxylic acid and/or an amino acid.

5. The additive according to claim 1, where (ii) is selected from the group consisting of 1,2,3,4-butanetetracarboxylic acid, citric acid, glycine and glutamic acid.

6. The additive according to claim 1, where the base is alkali metal base, alkaline earth metal bases; carbonates; ammonia; primary, secondary or tertiary amines; or bases with primary, secondary or tertiary amino groups.

7. The additive according to claim 1 in dishwashing detergents for machine dishwashers.

8. The additive according to claim 1, where the modified polyaspartic acid is preparable by polycondensation of (i) 60 to 95 mol % of aspartic acid and methanesulfonic acid in a ratio of 100:1 to 10:1, and (ii) 5 to 40 mol % of at least one carboxyl-containing compound, and subsequent hydrolysis of the cocondensates with the addition of a base, where (ii) is not an aspartic acid.

9. The additive according to claim 1, where the modified polyaspartic acid is preparable by polycondensation of (i) 80 to 95 mol %, of aspartic acid and methanesulfonic acid in a ratio of 50:1 to 12:1; and (ii) 5 to 20 mol %, of at least one carboxyl-containing compound, and subsequent hydrolysis of the cocondensates with the addition of a base, where (ii) is not an aspartic acid.

10. A dishwashing detergent composition comprising (a) 1-20% by weight of at least one modified polyaspartic acid preparable by polycondensation of (i) 50 to 99 mol % of aspartic acid and methanesulfonic acid in a ratio of 200:1 to 5:1; and (ii) 1 to 50 mol % of at least one carboxyl-containing compound, and subsequent hydrolysis of the cocondensates with the addition of a base, where (ii) is not aspartic acid;

(b) 0-50% by weight of complexing agent;

(c) 0.1-80% by weight of builders and/or cobuilders;

(d) 0.1-20% by weight of nonionic surfactants;

(e) 0-30% by weight of bleaches and bleach activators;

(f) 0-8% by weight of enzymes; and (g) 0-50% by weight of additives.

11. The dishwashing detergent composition according to claim 10, where the composition is suitable for machine dishwashers.

12. The dishwashing detergent composition according to claim 10, comprising (a) 2-12% by weight of at least one modified polyaspartic acid;

(b) 3-50% by weight of methylglycinediacetic acid and salts thereof;

(c) 15-65% by weight of builders and/or cobuilders (d) 0.5-10% by weight of nonionic surfactants (e) 0-30% by weight of bleaches and bleach activators (f) 0-8% by weight of enzymes; and 0-50% by weight of additives.

13. The additive according to claim 1, where the modified polyaspartic acid is preparable by polycondensation of (i) 80 to 95 mol %, of aspartic acid and methanesulfonic acid in a ratio of 200:1 to 5:1; and (ii) 5 to 20 mol %, of at least one carboxyl-containing compound, and subsequent hydrolysis of the cocondensates with the addition of a base, where (ii) is not an aspartic acid.

* * * * *